United States Patent [19]

Gerstung

[11] Patent Number: 4,714,247

[45] Date of Patent: Dec. 22, 1987

[54] PLANCHE TRAINER

[76] Inventor: Siegfried H. Gerstung, 1306 Westellen Rd., Baltimore, Md. 21204

[21] Appl. No.: 18,479

[22] Filed: Feb. 25, 1987

[51] Int. Cl.[4] ..... A63B 7/00

[52] U.S. Cl. ..... 272/109; 272/93; 272/123; 272/119

[58] Field of Search ..... 272/109, 93, 119, 123, 272/144, 116; 128/75, 76 R, 78, 84 R, 84 C, 87 B

[56] References Cited

U.S. PATENT DOCUMENTS

| | | | |
|---|---|---|---|
| 1,047,212 | 12/1912 | Hamilton | 272/122 |
| 2,357,746 | 9/1944 | Kuss | 272/94 |
| 2,855,202 | 10/1958 | Kinne | 272/94 |
| 3,322,425 | 5/1967 | Moore | 272/94 |
| 3,359,976 | 12/1967 | Laval, Jr. | 128/75 |
| 3,379,439 | 4/1968 | Sorenson et al. | 272/109 X |
| 4,214,382 | 7/1980 | Matsutani | 35/29 R |
| 4,221,074 | 9/1980 | Gonzalez | 272/119 X |
| 4,407,497 | 10/1983 | Gracie | 272/119 |
| 4,539,979 | 9/1985 | Bremer | 128/75 |

FOREIGN PATENT DOCUMENTS 1053839 11/1983 U.S.S.R. .

OTHER PUBLICATIONS

Antsyperov, "Gear for Teaching Young Gymnasts Stationary Exercise", 1980, pp. 19 & 20 of vol. 1, Gymnastics, published in Moscow, U.S.S.R., (English translation attached).

*Primary Examiner*—Richard J. Apley
*Assistant Examiner*—J. Welsh
*Attorney, Agent, or Firm*—Cushman, Darby & Cushman

[57] ABSTRACT

A device for assisting a person to learn a gymnastic feat includes a board, a pad secured to the board for protecting the person's body from contact with the board, a pole being secured to and having a portion extending beyond the board, the extending portion first being angled rearwardly then extending generally parallel to the board, and a harness for the person to wear the device. The portion of the pole extending beyond the board may have either a plurality of weights slidable thereon or a pair of hand grips that are held by a "spotter" or coach who is assisting the person to learn the gymnastic feat. The device is particularly useful for learning any routine in which the planche position is assumed.

10 Claims, 10 Drawing Figures

Fig. 1
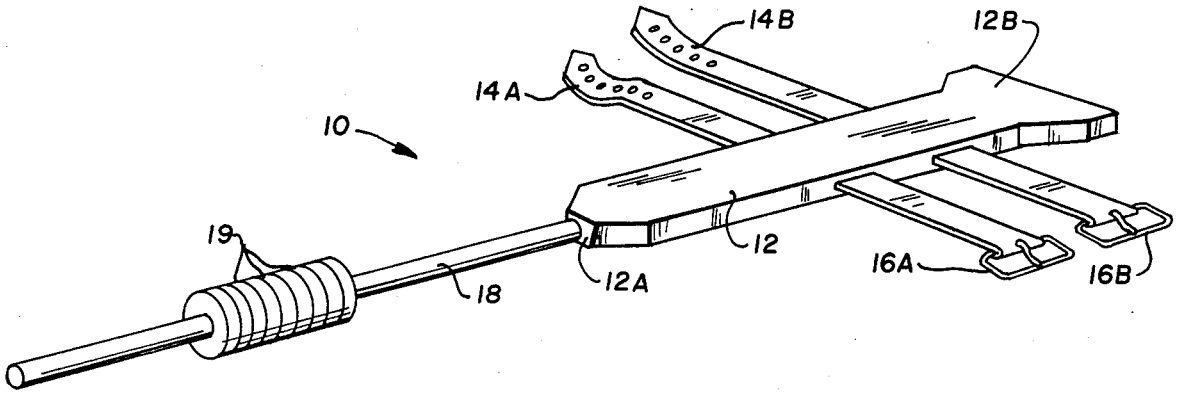
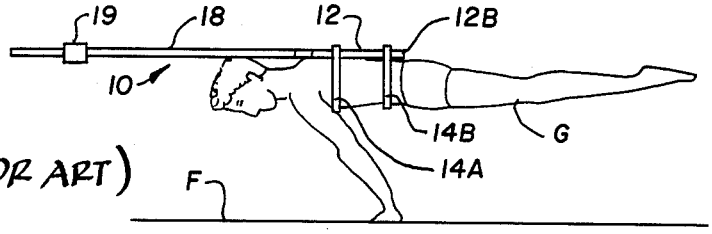
Fig. 2A (PRIOR ART)
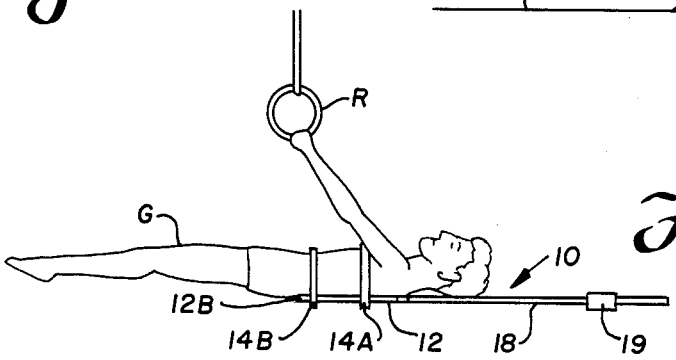
Fig. 2B (PRIOR ART)
Fig. 2C (PRIOR ART)
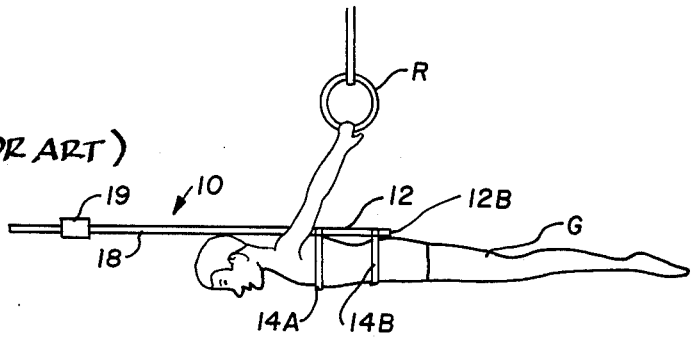

PLANCHE TRAINER

BACKGROUND OF THE INVENTION

1. Field of the Invention

The present invention relates generally to an exercising device and, in particular, to a piece of gymnastic equipment worn on a user's body for aiding the user to learn a "planche" feat.

2. Description of the Related Art

A "planche" is the name of a particular gymnastic feat, exercise or routine performed on either rings, parallel bars or a vaulting horse. In the feat, the gymnast makes his or her body straight as a board. The name of the feat comes from the French word "planche" meaning either "board" or "plank".

A training device for aiding Soviet gymnasts to learn the planche feat is known from a Russian magazine article published in 1980 and is shown in FIGS. 1 through 2C of the drawings.

In FIG. 1, a perspective view of the Soviet training device 10 is shown. The device 10 has a rigid wooden back board 12, a first leather chest belt 14A, and a second leather abdominal belt 14B. The two belts 14A and 14B have metal buckles 16A and 16B, respectively. A rigid metal pole 18 projects from a narrowed portion 12A at an upper end of the board 12 and has a plurality of weights 19 thereon which are slidable along the length of the pole 18. At an opposite end of the board 12, there is a widened portion 12B which contacts a gymnast's lower back.

In FIG. 2A, a gymnast G is seen performing an exercise on a floor F with the training device 10 of the prior art. In FIG. 2B, the gymnast G is wearing the training device 10 to perform the planche feat on rings R while in FIG. 2C the gymnast G is wearing the training device 10 to learn the planche feat in an inverted position on the rings R.

Although the training device 10 of the prior art is helpful to the gymnast G in learning the planche feat, it has certain disadvantages which may be seen from FIGS. 2A through 2C. First of all, the wooden board 12, the leather belts 14A and 14B, and the metal buckles 16A and 16B are extremely hard and uncomfortable to wear on the gymnast's body, because the belts 14A and 14B are not extensible, they do not move with the rhythm of the gymnast's breathing and therefore may allow the device 10 to slip down the wearer's body when the gymnast is standing and exhales air especially if the device 10 was strapped on when the gymnast had his or her lungs full of air. Also, the widened portion 12B at the lower end of the wooden board 12 tends to dig into the gymnast's back if the planche feat is not being done correctly, particularly when the gymnast's lower trunk and legs are not perfectly straight but drop at an angle. This digging into the gymnast's back by the widened portion 12B if the legs drop is particularly evident when the gymnast G is trying to learn the planche feat in the upwardly facing position shown in FIG. 2B. Finally, because the pole 18 is straight, the weights 19 have a tendency to slide downwardly and strike the back of the gymnast's head whenever the gymnast G is either standing or tilting at an angle with the head leaning upwardly and the legs pointing downwardly.

Because of these and other disadvantages in the known training device 10 of the prior art, there is a need to develop a piece of gymnastic equipment which would be helpful in learning the planche feat but which would also be comfortable to wear and safe to use.

SUMMARY OF THE INVENTION

The present invention relates to a piece of gymnastic equipment worn on a user's body. The equipment is helpful in learning the planche feat while, at the same time, it is also comfortable to wear and safe to use. The equipment is used to aid amateur gymnasts in training for the Olympics as well as to aid professional gymnasts in learning new types of planche feats.

The equipment provides optimal strength training for the planche position and allows for variable resistance training by sliding weights along the pole so that the gymnast experiences maximum muscle fatigue in a short period of time. This training device of the present invention develops major muscle groups such as deltoids, pectorals, and triceps.

The present invention may also be used to help an aspiring gymnast learn many other basic positions, such as the backhand spring, the Tsukahara vault, free hip circles, stalders, giant swings, back levers, and front levers, as well as planches. Direct and effective enhancement of a gymnast's ability to perform these various exercises is achieved quickly by both men and women alike.

These and other advantages of the present invention will become more readily apparent from the following detailed description of the preferred embodiments of the present invention after viewing the accompanying drawings.

BRIEF DESCRIPTION OF THE DRAWINGS

FIG. 1 shows a perspective view of a known prior art device;

FIG. 2A shows a first side elevational view of the prior art device in use by a gymnast learning to assume a planche position on a floor;

FIG. 2B shows a second side elevational view of the prior art device in use by a gymnast learning to assume an upwardly facing planche position on rings;

FIG. 2C shows a third side elevation view of the prior art device in use by a gymnast learning to assume a downwardly facing planche position on the rings;

DETAILED DESCRIPTION OF THE PREFERRED EMBODIMENTS

Figure 3:
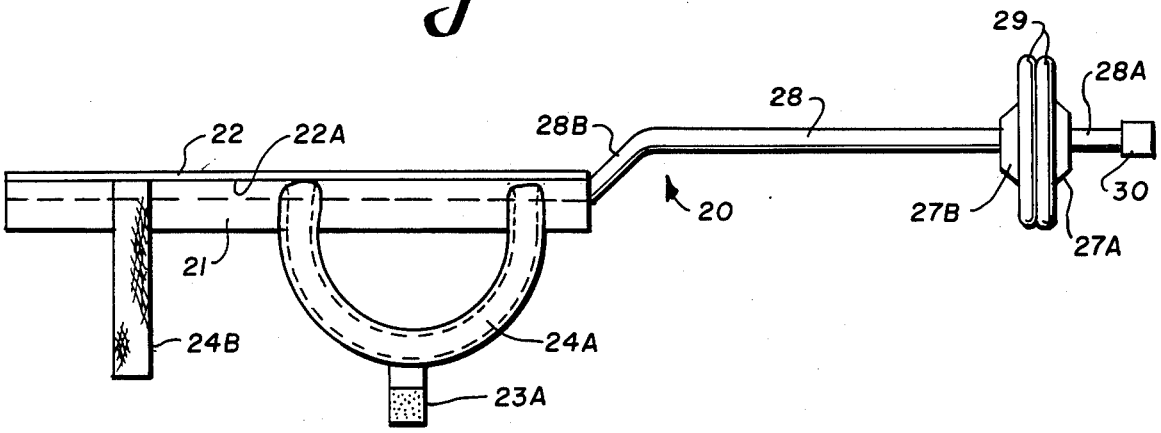
FIG. 3 shows a side elevational view of the training device of the present invention.
Figure 4:
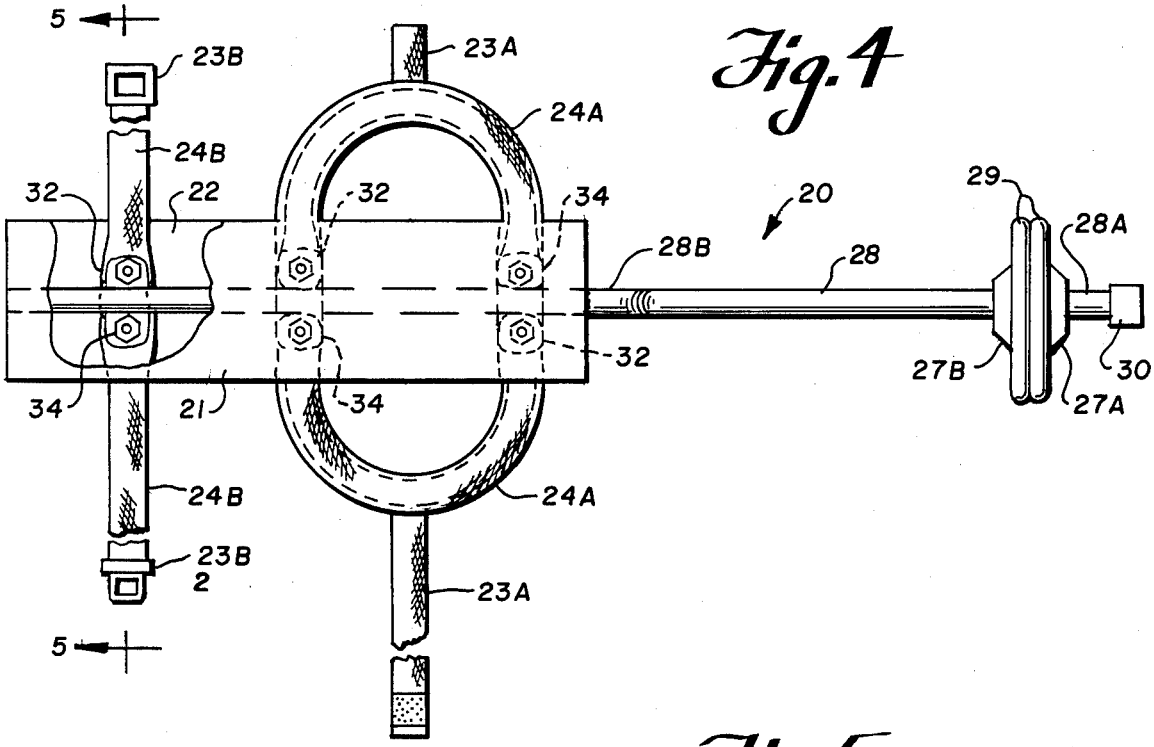
FIG. 4 shows a top plan view of the training device of the present invention with a section cut away.
Figure 5:
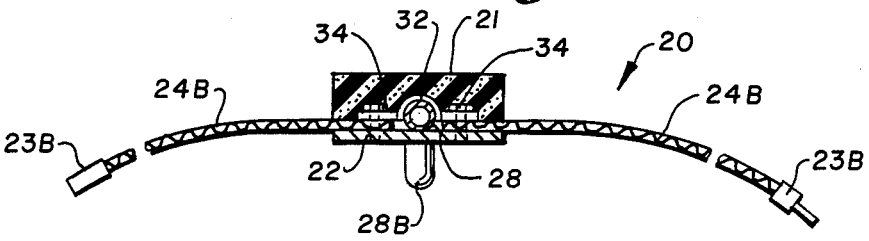
FIG. 5 shows a cross-sectional view taken along line 5—5 of FIG. 4.

In FIGS. 3 through 5, a training device 20 of the present invention is shown in a side elevational view.

The training device 20 has a rigid wooden back board 22 with a front face 22A to which there is secured a coextensive cushioned pad 21 for protecting and making a gymnast's back comfortable. The board 22 with its overlying pad 21 comes in different lengths and is adapted to extend from the back of a gymnast's neck to a lower end of the gymnast's buttocks. A pair of semicircular extensible padded straps 24A are adapted to loop around the gymnast's arms and are held close to the gymnast's chest by a first interlocking belt 23A made of Velcro®. A second belt 24B is adjustable about the gymnast's hips and has a quick-release safety belt 23B attached at opposite ends thereof. The safety belt 23B is the type used for securing passengers in their seats while traveling in automobiles and airplanes.

A rigid metal pole 28 extends along the entire length of the board 22 and therebeyond by a portion having an extent at least equal to or greater than the length of the board 22. A plurality of weights 29 is retained by holders 27A and 27B on the portion of the pole 28 extending beyond the board 22. These weights 29 are slidable along the extended portion of the pole 28 but may be secured therealong at a selected position by the holders 27A and 27B which are, in turn, adjustably tightened or frictionally fitted onto the pole 28. These holders 27A and 27B may be shaped as hand grips (see FIGS. 6 and 7) for a "spotter" or a coach to manipulate the training device 20 when the weights 29 are not being used. In the event that the first holder 27A is not sufficiently tightened onto the pole 28 and subsequently becomes loose so that the plurality of weights begin to slide toward one end 28A of the pole 28, a cap 30 is provided on this one end 28A. The cap 30 may be retained thereon either by internal screw threading or other suitable securing means. Likewise, in the event that the second holder 27B is not sufficiently tightened onto the pole 28 and becomes loose so that the weights 29 begin to slide towards the head of the user wearing the training device 20, the pole 28 is provided with a bent section or midportion 28B which is actually a kink made adjacent to the board 22. This kink prevents the weights 29 from sliding any farther towards the user's head.

As seen only in FIGS. 4 and 5, the pole 28 is secured to the wooden back board 22 by clamps 32 which are fitted over opposite ends of both the straps 24A and the second belt 24B. The clamps 32 are held to the board 22 by bolts 34 or other suitable fastening means.

Figure 6:
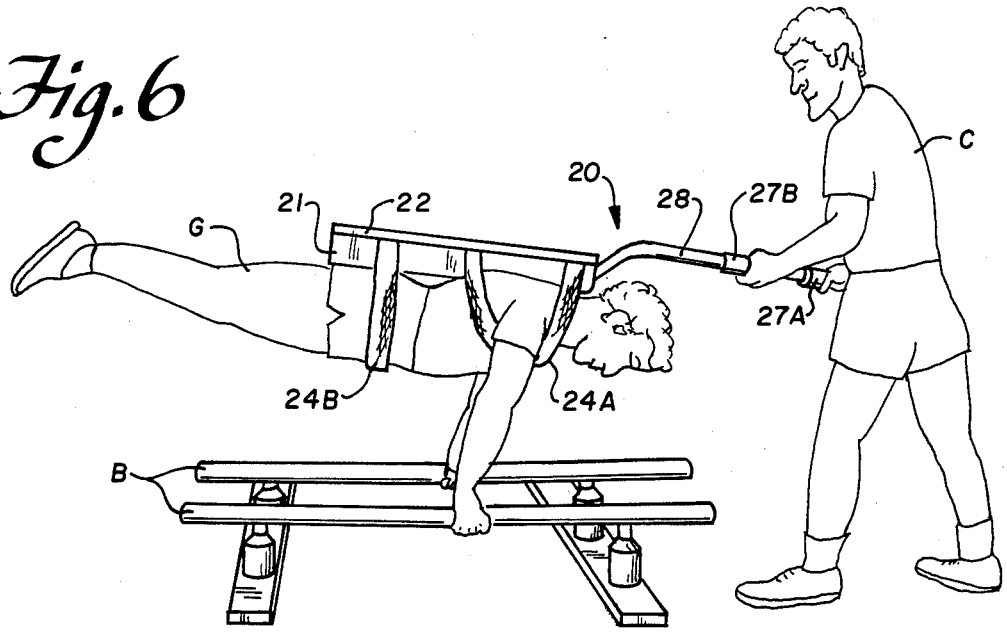
FIG. 6 shows a perspective view of the training device of the present invention being worn by a gymnast who is assisted by a coach in assuming a downwardly facing horizontal planche position on low parallel bars.
Figure 7:
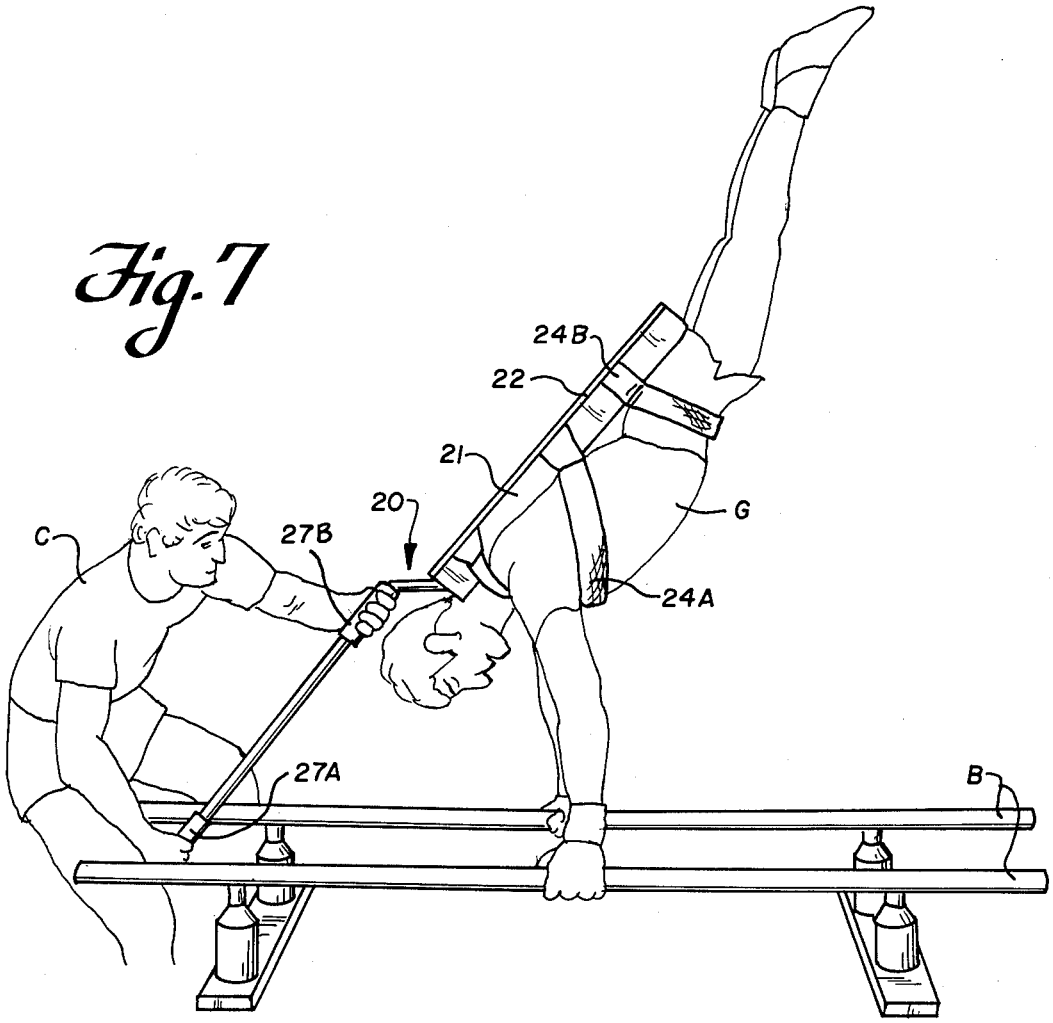
FIG. 7 shows a perspective view of the training device of the present invention being worn by a gymnast who is assisted by a coach in assuming a vertical planche position on low parallel bars.
Figure 8:
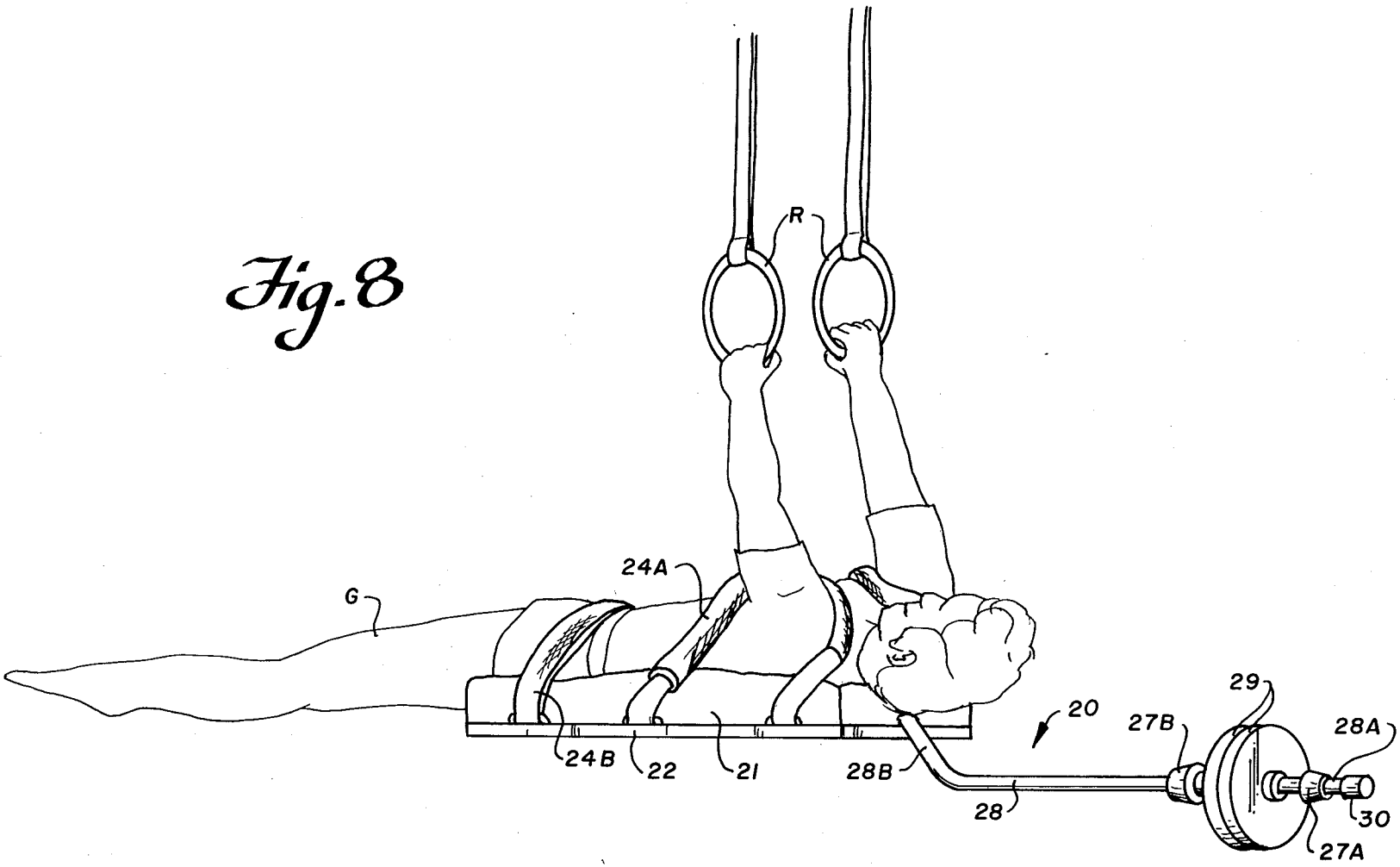
FIG. 8 shows a perspective view of the training device of the present invention being worn by a gymnast who is unassisted in assuming an upwardly facing horizontal position on rings.

Referring now to FIGS. 6–8, the use of the training device 20 of the present invention will be explained. As seen in FIG. 6, the gymnast G is learning a planche feat on the low parallel bars B. The gymnast is wearing the training device 20 and is assisted by a "spotter" or a coach C. For this particular horizontal planche feat, the weights 29 have been removed from the pole 28 so that leverage may be applied directly by the coach C who is gripping the holders 27A and 27B. The hard wooden board 22 is spaced from the back of the gymnast G by the coextensive pad 21. The straps 24A looped around the arms and the second belt 24B secured around the hips of the gymnast G allow the coach C to exert leverage without causing the wooden board 22 to contact any parts of the body of the gymnast G.

As seen in FIG. 7, the gymnast G is being assisted by the coach C to be raised into a vertical planche position on the low parallel bars B. Again, because the straps 24A looped around the arms and the second belt 24B secured around the hips of the gymnast G firmly retain the back board 22 and its protective pad 21 to the gymnast G, the coach C is able to exert leverage on the body of the gymnast G without causing any injury or discomfort to the gymnast G.

As seen in FIG. 8, the gymnast G is developing his muscles and learning the upwarding facing horizontal planche position on rings R without the assistance of a coach C holding the pole 28. Leverage is provided by the plurality of weights 29 which are retained between selected positions by the holders 27A and 27B that are disklike and not shaped as the hand grips shown in FIGS. 6 and 7. In this particular embodiment shown in FIG. 8, the disklike holders 27A and 27B are frictionally secured onto the pole 28. The cap 30 acts as a backup holder in the unlikely event that the first holder 27A becomes loose while the bent midportion 28B of the pole 28 prevents the weights 29 from striking the head of the gymnast G in the likewise unlikely event that the second holder 27B fails to retain the weights 29 in the selected range along the extended length of the pole 28. The straps 24A looped around the arms and the second belt 24B secured around the hips of the gymnast G firmly secure the back board 22 with its protective pad 21 to the gymnast G so that the weights 29 on the one end 28A of the pole 28 can provide the leverage which the gymnast G needs to counterbalance the weight of his fully extended legs. Thus, in this balanced position, the gymnast G can build up the muscle groups essential for performing the horizontal planche feat and can develop a sense for the proper orientation to assume after the muscles are sufficiently strong enough to support the body without wearing the training device 20 of the present invention.

Thus, in conclusion, the training device 20 of the present invention is characterized by and distinguished over the training device 10 of the prior art by a more elaborate harness for holding the device 20 onto the gymnast's body, by a board 22 with a comfortable pad 21 for protecting the gymnast's back, and by a holding arrangement for safely retaining the weights 29 which may be easily moved towards and away from the gymnast's body and which also may allow the coach C to either add or take away individual weights 29 that counterbalane the lower torso of the gymnast's body.

The foregoing preferred embodiments shown in FIGS. 3–8 are considered illustrative only. Numerous other modifications and changes will readily occur to those persons skilled in the art of gymnastics after reading this disclosure. Consequently, the disclosed training device of the present invention is not limited to the exact construction and operation shown and described hereinabove but rather is encompassed within the scope of the following claims.

I claim:

1. A device for assisting a person to learn a gymnastic feat, comprising:

a board adapted to extend from the back of the person's neck to the lower end of the person's buttocks, said board having a front face;

a pad means, secured to the front face of the board for protecting the person's body from contact with the board;

a pole being secured to the board and having a portion extending beyond the board, said pole having a first portion adjacent to the board which is angled rearwardly from the board's front face and a second portion extending from said first portion generally parallel to the board; and means, secured to the board, for harnessing the device to the person's body.

2. The device according to claim 1 wherein:

said harnessing means includes strap means adapted for encircling the person's arms.

3. The device according to claim 2 wherein:

said harnessing means further includes a first belt means for holding the strap means together and also includes a second belt means adapted for encircling the person's hips.

4. The device according to claim 3 wherein:

said first belt means is made of interlocking Velcro ® and said second belt means includes a safety belt buckle.

5. The device according to claim 1 further comprising:

means, secured to the board, for clamping the pole and the harnessing means to the board.

6. The device according to claim 1 further comprising:

a cap retained on an end of the pole remote from the board.

7. The device according to claim 6 further comprising:

holders adjustably arranged along the second portion of the pole.

8. The device according to claim 7 further comprising:

a plurality of weights slidable along the second portion of the pole and arranged between the holders.

9. A device for assisting a person to learn a gymnastic feat, comprising:

a stiff board member having a resiliently padded front face;

means secured to the board member for harnessing the stiff board member onto a person's torso so that the stiff board member extends up the back side of the person's body from the lower extent of the person's neck, with the resiliently padded front face disposed forwardly and in contact with the back side of the person's body; and a rigid pole being secured to said stiff board member and extending longitudinally and medially thereof a substantial distance beyond an upper end of said stiff board member, so as to have an upper end located, in use, longitudinally beyond the person's head;

said rigid pole having a first portion adjacent said upper end of said stiff board member, said first portion extending obliquely rearwardly so as to stand clear of the back of the person's head, in use;

said rigid pole also having a second portion which extends more nearly parallel to, but rearwardly of the longitudinal axis of said stiff board member to said upper end of said rigid pole.

10. The device according to claim 9, further comprising:

a plurality of weights removably secured to the second portion of the rigid pole.

* * * * *